US012029956B2

(12) United States Patent
Benoit et al.

(10) Patent No.: US 12,029,956 B2
(45) Date of Patent: Jul. 9, 2024

(54) OVERSPEED GOLF SWING TRAINING DEVICE

(71) Applicants: Luke A. Benoit, Minneapolis, MN (US); Timothy Ramos, Blaine, MN (US)

(72) Inventors: Luke A. Benoit, Minneapolis, MN (US); Timothy Ramos, Blaine, MN (US)

( * ) Notice: Subject to any disclaimer, the term of this patent is extended or adjusted under 35 U.S.C. 154(b) by 304 days.

(21) Appl. No.: 17/340,771

(22) Filed: Jun. 7, 2021

(65) Prior Publication Data

US 2021/0379464 A1 Dec. 9, 2021

Related U.S. Application Data

(60) Provisional application No. 63/102,276, filed on Jun. 8, 2020.

(51) Int. Cl.
*A63B 69/36* (2006.01)
*A63B 102/32* (2015.01)

(52) U.S. Cl.
CPC ..... *A63B 69/3635* (2013.01); *A63B 2102/32* (2015.10); *A63B 2225/01* (2013.01)

(58) Field of Classification Search
CPC ..... A63B 2053/0491; A63B 69/3635; A63B 2225/01; A63B 2102/32
USPC ..... 473/324–350, 287–292, 457, 219–242, 473/256
See application file for complete search history.

(56) References Cited

U.S. PATENT DOCUMENTS 1,549,350 A * 8/1925 Deike ..... A63B 69/3635 473/234
2,396,408 A * 3/1946 Benecke ..... A63B 69/3635 473/234
2,950,919 A * 8/1960 Cadman ..... A63B 69/3638 D21/759
3,133,735 A * 5/1964 Greenshields ..... A63B 69/3638 473/256
3,419,275 A * 12/1968 Winkleman ..... A63B 53/0487 473/335
3,575,419 A * 4/1971 Davis ..... A63B 69/3635 473/234
3,637,218 A * 1/1972 Carlino ..... A63B 53/02 473/330
3,743,297 A * 7/1973 Dennis ..... A63B 15/00 482/109
3,909,005 A * 9/1975 Piszel ..... A63B 53/007 473/336
4,000,893 A 1/1977 Evans
4,283,057 A * 8/1981 Ragan ..... A63B 53/04 446/216
4,602,788 A * 7/1986 Wendt ..... A63B 15/00 482/109
4,842,280 A * 6/1989 Hilton ..... A63B 69/3638 473/238

(Continued)

*Primary Examiner* — Sebastiano Passaniti
(74) *Attorney, Agent, or Firm* — Merchant & Gould P.C.

(57) ABSTRACT

A swing speed training club includes a shaft having a proximal end and a distal end; and a head portion affixed to the distal end of the shaft and having a body having a proximal end and a distal end. The head portion is configured to produce a distinctive sound when the head portion is swung through the air at the distal end of the club shaft at a suitable speed.

10 Claims, 7 Drawing Sheets

(56) References Cited

U.S. PATENT DOCUMENTS 4,872,684 A * 10/1989 Dippel ..... A63B 53/0487 273/DIG. 11
4,878,672 A 11/1989 Lukasiewicz
4,953,868 A * 9/1990 Thompson ..... A63B 69/3635 84/273
5,244,210 A * 9/1993 Au ..... A63B 53/0487 473/336
5,465,967 A 11/1995 Boeckenhaupt
5,501,461 A * 3/1996 Donofrio ..... A63B 53/0487 473/251
5,571,053 A * 11/1996 Lane ..... A63B 53/065 473/340
5,632,694 A * 5/1997 Lee ..... A63B 53/04 473/340
5,868,633 A * 2/1999 Keheley ..... A63B 69/3635 473/224
6,059,669 A * 5/2000 Pearce ..... A63B 53/04 473/339
6,186,904 B1 2/2001 Bass
6,379,261 B1 4/2002 Hart
6,435,976 B1 * 8/2002 Galliers ..... A63B 53/0487 473/251
6,443,851 B1 9/2002 Liberatore
6,458,044 B1 * 10/2002 Vincent ..... A63B 53/04 473/409
6,475,098 B1 * 11/2002 Nemeckay ..... A63B 15/00 473/345
6,523,183 B1 2/2003 Wright et al.
6,612,936 B1 9/2003 Matias
6,866,592 B1 * 3/2005 Gitre ..... A63B 21/0088 473/437
6,955,610 B1 10/2005 Czaja et al.
7,413,517 B2 8/2008 Butler, Jr. et al.
8,282,510 B1 * 10/2012 Englund ..... A63B 69/0002 473/464
8,414,412 B2 4/2013 Kim
8,491,404 B2 * 7/2013 Kim ..... A63B 69/3632 473/219
8,529,365 B1 * 9/2013 Davis ..... A63B 53/02 473/256
8,814,714 B1 8/2014 Hjertstedt
9,061,186 B2 6/2015 Larson
9,381,406 B2 7/2016 Boggs
9,579,557 B1 2/2017 Molinelli et al.
10,004,962 B2 6/2018 Codd et al.
10,596,440 B2 * 3/2020 Verrengia ..... A63B 53/10
10,994,184 B1 * 5/2021 Snyder ..... A63B 15/00
11,167,193 B2 * 11/2021 Christiansen ..... A63B 69/3632
2003/0139224 A1 7/2003 Gale et al.
2004/0009826 A1 * 1/2004 Aisenberg ..... A63B 69/3632 473/256
2004/0023726 A1 2/2004 Ritson et al.
2007/0004532 A1 * 1/2007 Lee ..... A63B 69/3685 473/336
2011/0300963 A1 * 12/2011 Kim ..... A63B 69/3635 473/234
2016/0067570 A1 * 3/2016 Larson ..... A63B 60/02 473/337
2017/0087429 A1 3/2017 Nielson et al.
2018/0178101 A1 6/2018 Francis

* cited by examiner

OVERSPEED GOLF SWING TRAINING DEVICE

CROSS-REFERENCE TO RELATED APPLICATION

This application claims the benefit of U.S. Provisional Patent Application Ser. No. 63/102,276, filed Jun. 8, 2020, which is incorporated herein by reference in its entirety.

This disclosure concerns a golf swing training club of adjustable weight for use in "overspeed" drills designed to increase the club head speed that a trainee can achieve in a "full" swing with a standard golf club.

BACKGROUND

Club head speed—that is, the speed at which the head of a golf club is traveling at the point where the club face impacts with the golf ball while making a golf swing—is one of several factors that determines how far the golf ball will travel after the impact. It also plays an important role in other properties of the ball's flight and performance during the shot. It is fair to say that many professional golfers, and most amateur golfers, would like to increase the club head speeds that they can produce with the driver, and with the other golf clubs in the bag.

Many club head speed improvement training regimens and training devices have been developed by others over the years. One of the more promising training regimens developed in recent years for this purpose (SuperSpeed™ Golf) is based upon so-called "overspeed" training techniques, and makes use of a set of four training clubs. The four standard SuperSpeed™ training clubs are identical except for weight, with each training club resembling a standard driver, but having a cylindrical metal head (rather than a standard golf club head) affixed to its distal end. Each of the four standard SuperSpeed™ training clubs has a head of a different weight. The standard SuperSpeed™ Golf training regimen makes use of three of the four SuperSpeed™ training clubs—which three depends primarily upon the age, strength and fitness of the trainee.

The expense and cumbersomeness for individual users, professional instructors, and golf pro shops of purchasing, storing, maintaining, and handling multiple multi-club sets of "overspeed" training clubs is significant.

SUMMARY

In its broadest aspects, this disclosure is directed to retaining effectiveness of a three-out-of-four-club overspeed training regimen while eliminating the expense and cumbersomeness associated with four separate clubs by replacing the four overspeed training clubs of prescribed weights with a single overspeed training club that is easily adjustable to each of the four prescribed weights.

In its narrower aspects, this disclosure provides a head portion of adjustable weight for an overspeed training club, and to provide the weight-adjustable head portion with particular features that allow it to be easily used.

In another aspect, this disclosure provides the training club with a counterweight feature, and with other feedback features, all of which make the training club of the present disclosure particularly effective.

In one aspect, a swing speed training club is provided comprising: (a) a shaft having a proximal end and a distal end; and (b) a head portion affixed to the distal end of the shaft and comprising a body having a proximal end and a distal end; and wherein the head portion is configured to produce a distinctive sound when the head portion is swung through air at the distal end of the club shaft at a suitable speed.

A sound-producing configuration of the body of the head portion can comprise a blind hole formed in, and open to, the distal end of the body to produce one or both of a humming or whistling sound when the head portion is swung through air at a suitable speed.

The sound-producing configuration of the body of the head portion may comprise three blind holes formed in, and open to, the distal end of the body arranged and spaced from each other around a perimeter of the distal end of the body.

In some examples, the club is configured for overspeed training of the user's golf swing, and wherein the shaft comprises a conventional golf club—style tapered shaft fitted with a conventional golf club—style grip near the shaft distal end.

The head portion can be configured to be weight-adjustable.

In one or more embodiments, the shaft has a length that is of conventional driver length and weight for a male golfer, and the head portion is configured to be weight-adjustable in four discrete increments from a minimum weight of about 154 grams to a maximum weight of about 235 grams.

In another aspect, a swing speed training club is provided comprising: (a) a shaft having a proximal end and a distal end; and (b) a head portion affixed to the distal end of the shaft and comprising a body having a proximal end and a distal end; and wherein the head portion is configured to be weight-adjustable.

In many example embodiments, the body of the head portion is generally cylindrical in configuration and is formed to comprise at least one cylindrical chamber opening to the body proximal end and closed at the body distal end so that the chamber is loadable from the proximal end of the body with a generally cylindrical weight, so that the head portion can comprise no cylindrical weight or at least one cylindrical weight, and a loaded or unloaded status of the chamber is visually determinable from the proximal end of the body.

The head portion may further comprise a keeper that is moveable between a first position to load or unload the weight from the cylindrical chamber, and a second position to hold the weight in the cylindrical chamber when the club is in storage and/or in use without hindering visual determinability of the loaded or unloaded status of the chamber from the proximal end of the body during either the loaded or unloaded status.

In some embodiments, the body of the head portion comprises three generally cylindrical chambers, each opening to the proximal end of the body and each closed at the distal end of the body so that each chamber is loadable from the proximal end of the body with a generally cylindrical weight, so that the head portion can comprise no cylindrical weight or one cylindrical weight, or two cylindrical weights, or three cylindrical weights, and the keeper is moveable between a first position to load or unload each of the chambers and a second position to secure weights in each of the loaded chambers during use or storage of the club without hindering visual determinability of the loaded or unloaded status of each chamber from the proximal end of the body during either loaded or unloaded status.

The club can be configured for overspeed training of a user's golf swing, and wherein the shaft comprises a conventional golf club-style tapered shaft fitted with a conventional golf club-style grip near the shaft distal end.

In examples, the shaft has a length that is of conventional driver length, and weight for a male golfer, and the head portion is configured to be weight-adjustable in four discrete increments from a minimum weight of about 154 grams to a maximum weight of about 235 grams. In non-limiting examples, a typical adult male golfer will weigh at least 140 lbs, at least 150 lbs, at least 160 lbs, and no greater than 320 lbs, no greater than 300 lbs, or no greater than 280 lbs. In non-limiting examples, a conventional driver has a shaft length of 43-48 inches, often 44-46 inches.

In some implementations, the head portion is configured to produce a distinctive sound when the head portion is swung through the air at the distal end of the club shaft at a suitable speed.

In some embodiments, the sound is one or both of a humming or a whistling sound.

The club can be configured for overspeed training of a user's golf swing, and wherein the shaft comprises a conventional golf club-style tapered shaft fitted with a conventional golf club-style grip near the shaft distal end.

DETAILED DESCRIPTION

Figure 1:
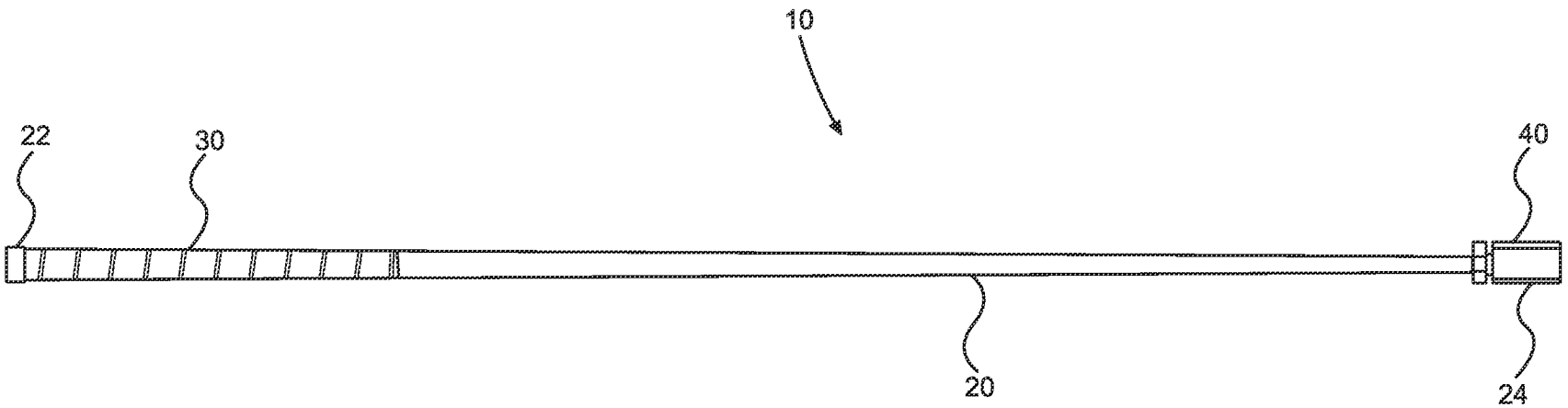
FIG. 1 is a side elevation view of the training club of an embodiment of the present invention.

The overspeed training club of this disclosure is generally indicated in the drawings by the reference number 10. The club comprises a shaft 20 having a proximal end 22 and a distal end 24. A grip 30 is secured at the proximal (or butt) end of shaft 20. A head assembly 40 is secured at the distal end of shaft 20. Each of a set of three weights 50 can be separately loaded into, or unloaded from, head assembly 40 to change the weight of the club.

Shaft 20 can be formed from a variety of materials that have commonly been used to form golf club shafts. It can be hollow or solid along all or part of its length. It can be straight or tapered or can have some other compound shape. In a preferred embodiment, the shaft is the length of a standard driver shaft (e.g., forty-two inches to forty-six inches), and is formed from a carbon fiber reinforced polymer material as a solid, tapered rod having a diameter of 0.580 inches at its proximal end and 0.335 inches at its distal end, weighing 60-85 grams, and having a flexibility in the range that is generally understood to be "stiff" to "extra stiff".

In a preferred embodiment, grip 30 is a standard golf club grip of a size, shape, material and texture that is commonly available. It is affixed to proximal end 22 of shaft 20 by means of a wrap of standard commercial grip tape (not shown) that is treated with a standard commercial grip tape solvent. When so affixed, grip 30 is very secure, but can be removed and replaced by another grip—perhaps one of different size, shape, material and/or texture according to the user's preferences, or perhaps to simply replace a worn or damaged grip with a fresh one—according to standard methods. Optionally, grip 30 can be configured to include grip guide features of a type generally known in the art to teach conventional gripping techniques.

Figure 2:
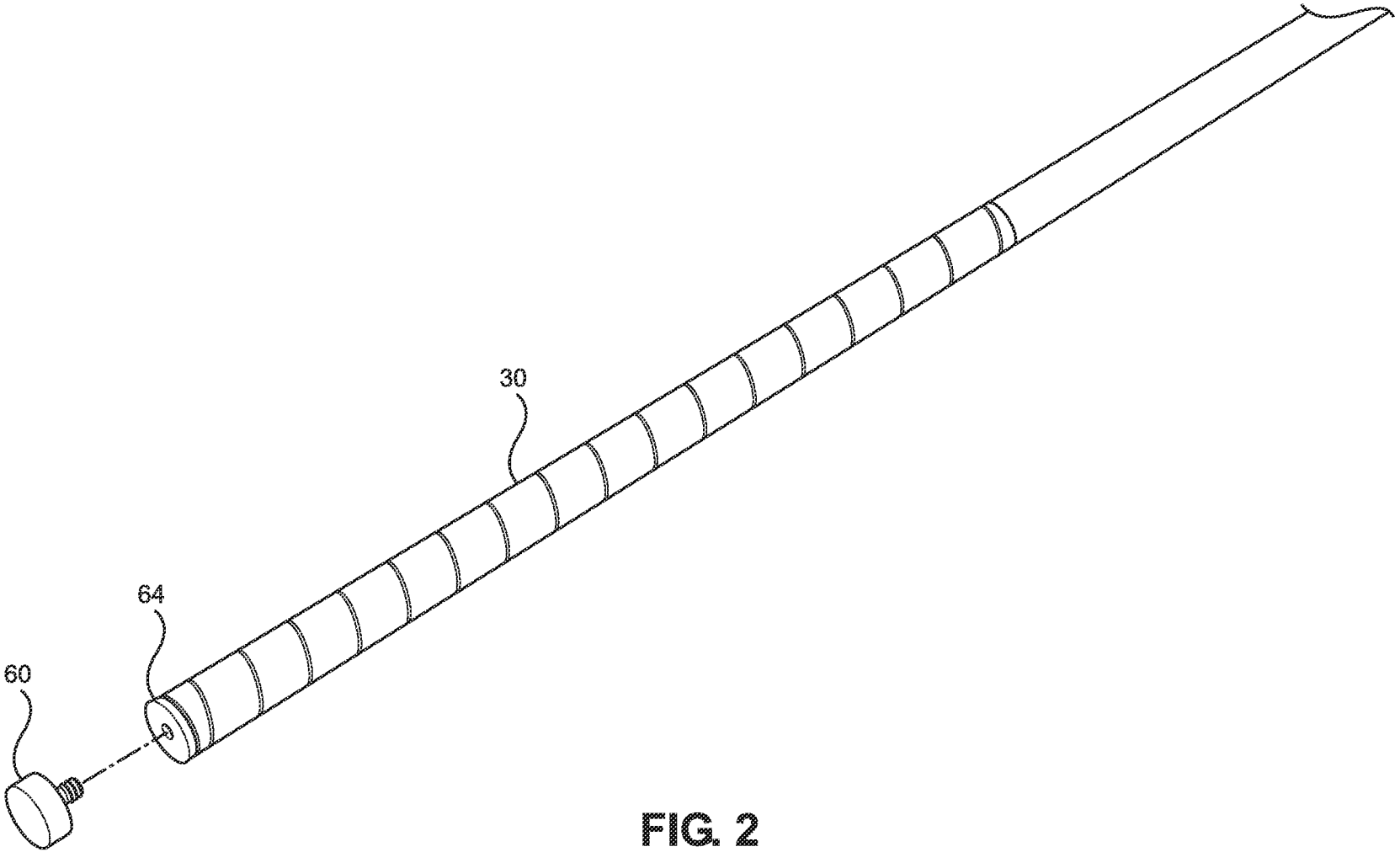
FIG. 2 is an exploded perspective view of the proximal end of the training club of FIG. 1.
Figure 3:
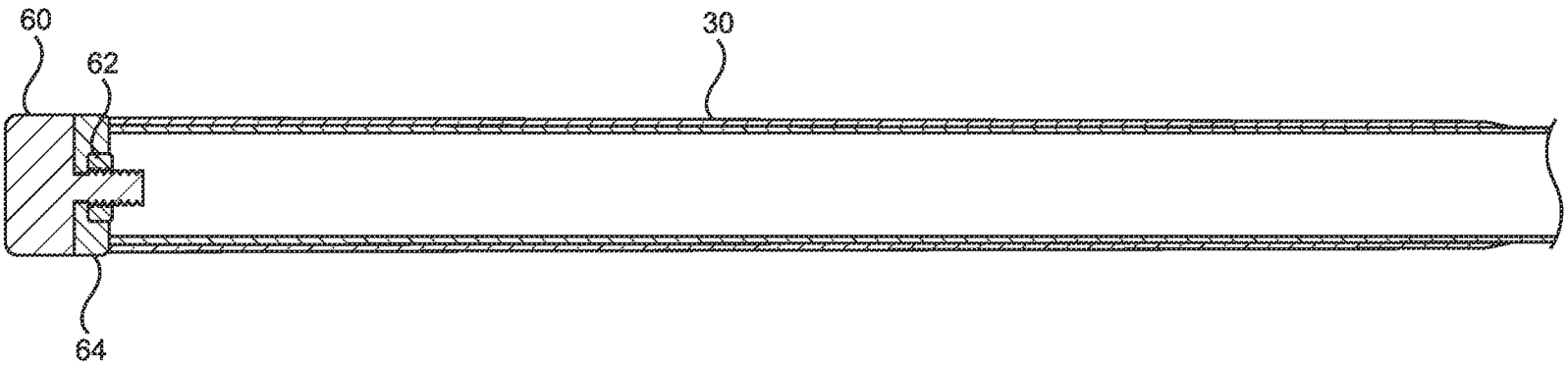
FIG. 3 is a cross-sectional view of the proximal end of the training club shown in FIG. 1.

Optionally, proximal end 22 of shaft 20 and/or the proximal end of grip 30 can be adapted to accept a counterweight. FIGS. 2 and 3 show one possible adaptation and arrangement for securing a counterweight 60 to the proximal end of shaft 20. In this arrangement, grip 30 is adapted by eliminating the usual integral cap portion covering the butt end of shaft 20, and the butt end of shaft 20 is adapted by boring out its center portion to a small extent. Threaded nut 62, preferably formed of metal, is cemented to the butt end of shaft 20 in alignment with the central bore of the shaft. A countersunk washer 64, preferably formed of a suitable plastic material, and finished appropriately, covers nut 62, and is also cemented to the butt end of shaft 20. The threaded shaft of counterweight 60 extends through the central opening in washer 64 and screws into the threaded nut 62. Counterweights of the configuration illustrated are commonly available on the market in a variety of weights, materials, and finishes.

Rather than fitting a counterweight to the butt end of the shaft 20, a swing training/analyzing device, such as a laser alignment arrangement can be fitted to the training location in a similar manner, or a motion sensing arrangement. A variety of such devices are available on the market.

Figure 4:
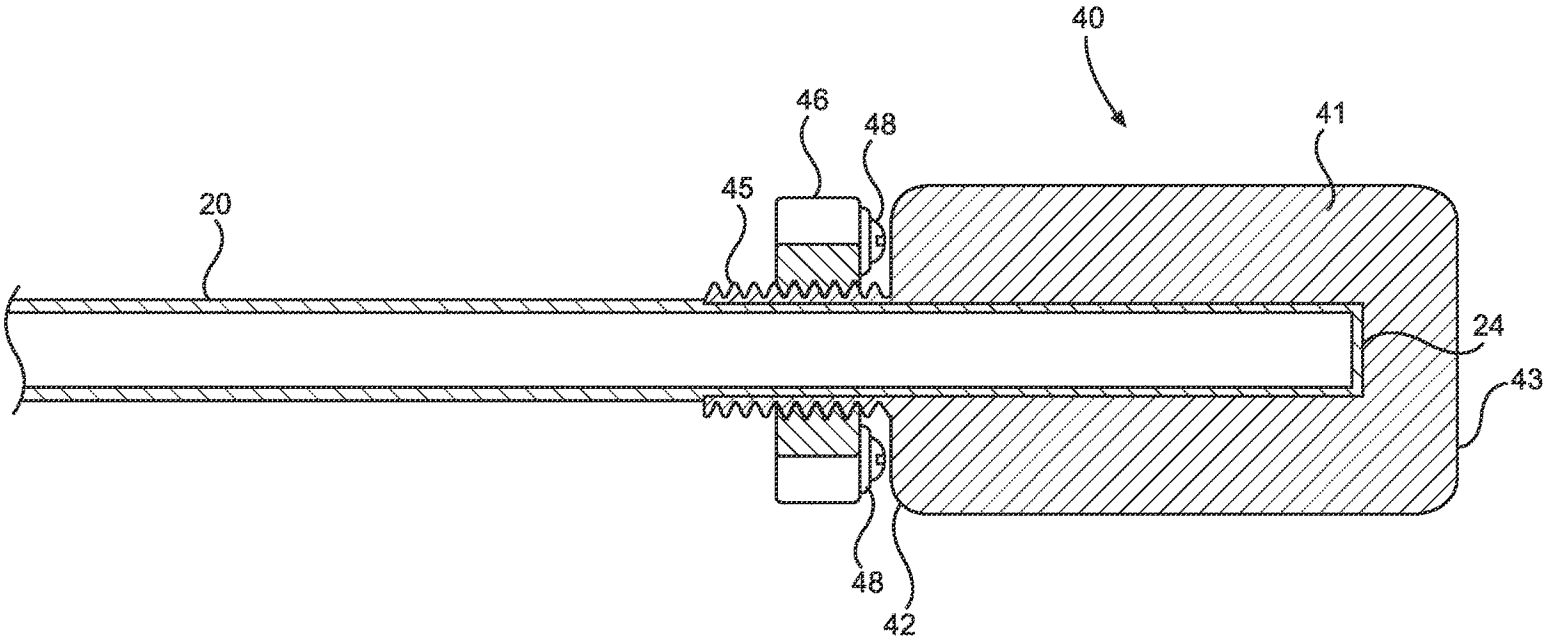
FIG. 4 is a cross-sectional view of the distal end of the training club shown in FIG. 1
Figure 5:
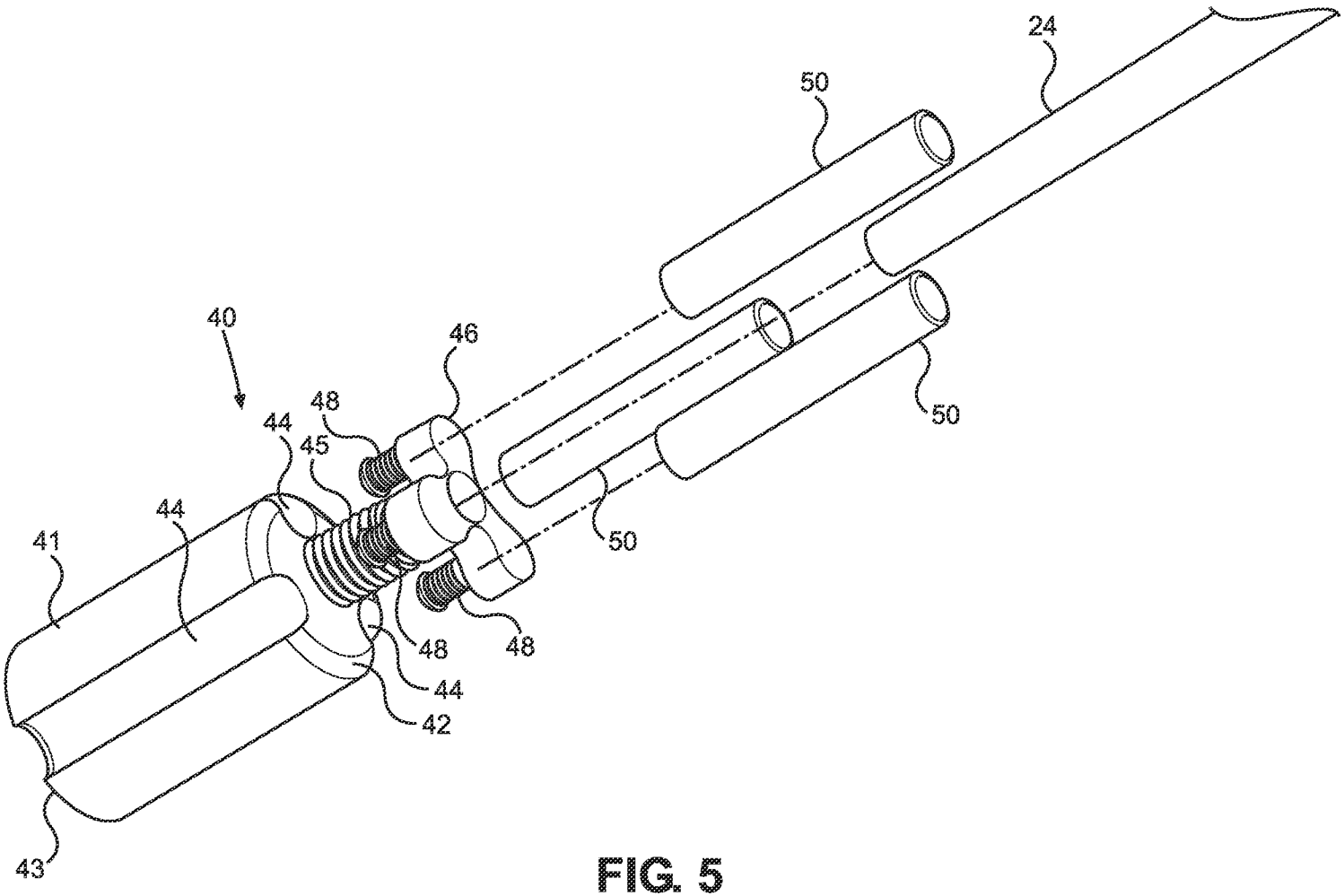
FIG. 5 is an exploded perspective view of the distal end of the training club shown in FIG. 1

Distal end 24 of shaft 20 is fitted with head assembly 40. For this purpose, and as shown in the sectional view of FIG. 4, head assembly 40 is provided with an axial bore sized to accept the distal end portion of shaft 20, which is secured there by means of conventional club head cement.

In a preferred embodiment, head assembly 40 comprises a generally cylindrical body 41, having a proximal end (aka top) 42 and a distal end (aka bottom) 43, and defining three essentially identical weight-receiving chambers 44 that are equally spaced around the perimeter of the body 41.

Each of the weight-receiving chambers is adapted so that it can be easily loaded (or unloaded) with one of three essentially identical and interchangeable weights 50. More specifically, each of the chambers 44 is open at the proximal end 42 of body 41 and closed at the distal end 43 of body 41, so that the weights can be inserted and removed through the open tops of the chambers 44.

In a preferred embodiment, the chambers 44 are essentially cylindrical in shape and are spaced from each other around the perimeter of body 41 by about 120 degrees. Weights 50 are likewise cylindrical in shape and sized to be of a length and diameter to so that each of the weights will essentially fill one of the chambers. Also in a preferred embodiment the walls of each chamber extend more than 180 degrees, but less than 360 degrees around each of the chambers. In a particularly-preferred embodiment, the walls extend about 270 degrees around the chambers. By thus leaving a portion of each chamber 44 open and exposed, the loading and unloading of the weights 50 from the chambers 44 is facilitated, as is visual verification that the proper number of weights are present in head portion 40 for a particular training session.

Figure 6:
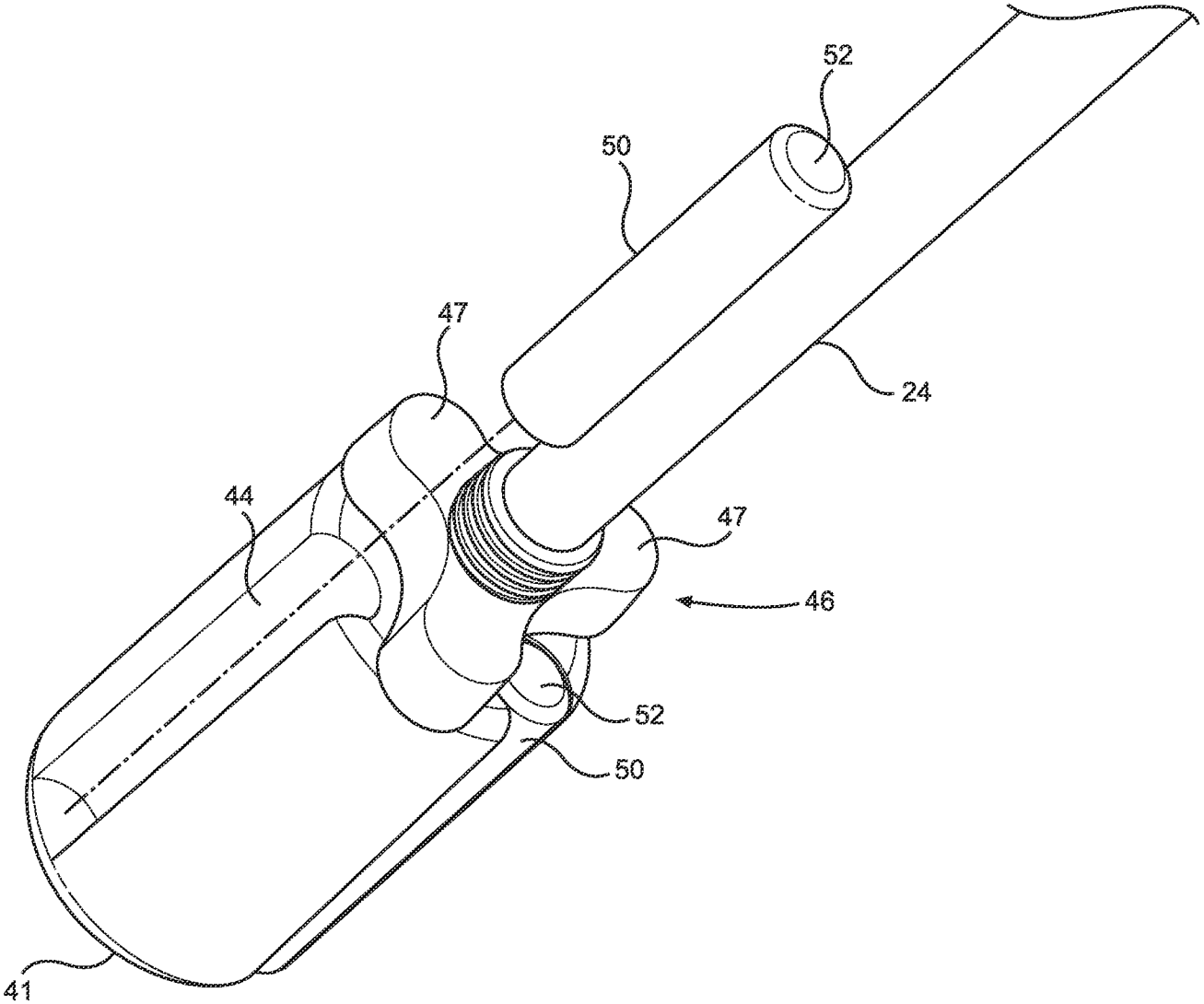
FIG. 6 is a perspective view of the distal end of the training club shown in FIG. 1, with the keeper in the open position and one weight loaded and one weight unloaded.
Figure 7:
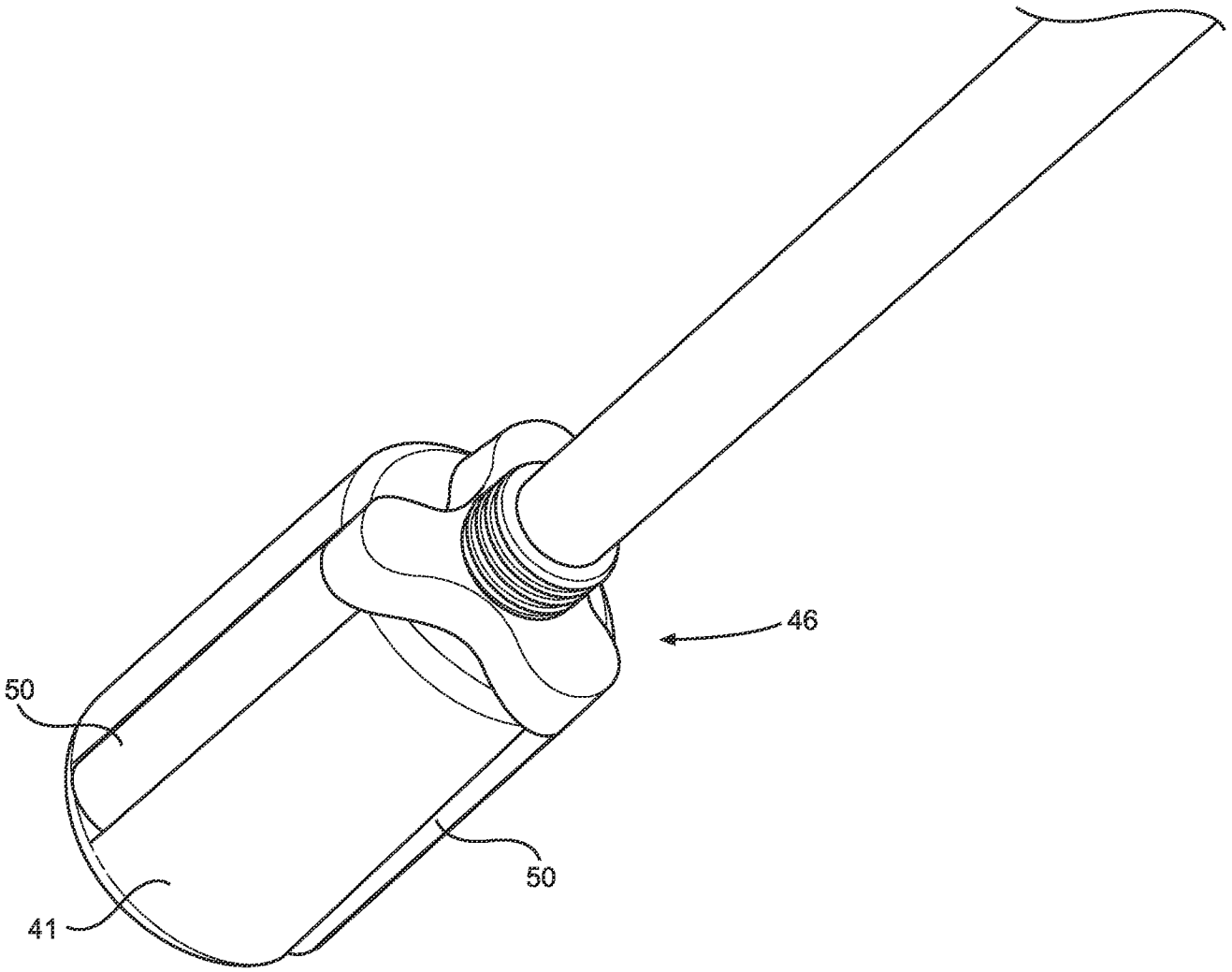
FIG. 7 is a perspective view of the distal end of the training club shown in FIG. 1, with the keeper in the closed position and three weights loaded (only two of which are visible in this view).
Figure 8:
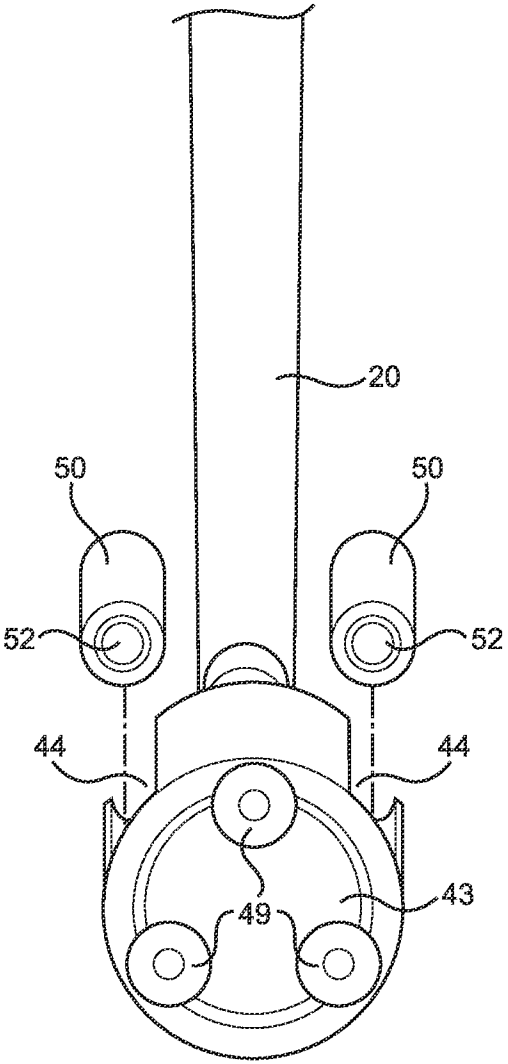
FIG. 8 is a bottom perspective view of the distal end of the body of the head assembly of the training club shown in FIG. 1.

In a preferred embodiment, an externally-threaded neck portion 45 is formed on the proximal end of body 41 of head assembly 40. A keeper 46 comprising an internally-threaded bore is threaded onto neck 45, so that keeper can be screwed down on top of body 41, or unscrewed away from the top of body 41. (In use, keeper 46 will generally be screwed down finger-tight to the top of body 41.) Keeper 46 further comprises three arms 47. Arms 47 are spaced about 120 degrees apart from each other and are of such a length that the keeper can be rotated on neck 45 to simultaneously open the tops of each of the chambers 44 or to simultaneously close the tops of each of the chambers 44. FIG. 6 shows the keeper 46 in the open position. FIG. 7 shows the keeper 46 in the closed position.

In a preferred embodiment, each end of each of the weights 50 is provided with a detent in the form of a central dimple 52, and each of the three arms of the keeper is provided with a ball-nose spring plunger mechanism 48 facing the top of body 41. Preferably, a dimple 52 is formed in each end of each of the weights 50, so that the weights can be loaded without regard to which end is placed up in the chambers 44. When one or more weights are present in the chambers, and the keeper is screwed down finger-tight to the top of body 41, this arrangement provides for a solid centering of the keeper arms over the tops of the chambers to securely hold the weight(s) in place for training drills, and a smooth and easy uncentering of the keeper arms to open the chambers to add or remove weights as needed.

In a preferred embodiment, body 41, keeper 46, and weights 50 are formed from stainless steel. Body 41 has a length of about two and one-eighth inches and a diameter of about one and one-eighth inches. Weight-receiving chambers 44 are each generally cylindrical in shape, have a length of about two inches and a diameter of about three-eighths of an inch. Weights 50 each have dimensions comparable to the dimensions of the chambers 44. In a preferred embodiment weights 50 are each of identical weight and configuration, and chambers 44 are each of identical configuration, so that each weight is not intended/assigned to be loaded into any particular chamber, although it is possible to envision training techniques that might make use of a different arrangement.

In a preferred embodiment as described above, the combination of body 41 and keeper 46 has a mass of about 154 grams, and the weights 50 each have a mass of about 27 grams. This configuration allows the mass/weight of head portion 40 to be easily adjusted from a minimum mass/weight of 154 grams to a maximum mass/weight of 235 grams, with intermediate masses/weights of 208 grams, 181 grams, and 154 grams. As a point of reference modern-day driver heads typically have a mass of about 205 grams.

In a preferred embodiment, body 41 is provided with at least one blind hole 49 in, and open to, its distal end 43. Preferably the hole is about one and three-quarters inches deep and five sixteenths of an inch in diameter. More preferably, three such blind holes are so formed in the distal end 43 near its perimeter, and are spaced apart by about 120 degrees. This arrangement provides a distinctive "humming" or "whistling" sound when appropriate swing speeds are attained during training. Without being bound to any particular theory, it is believed that a column of air that is present within each such blind hole resonates when air is passed across the opening of the hole (by swinging the training club), to produce the distinctive sound—much like a bottle produces such a sound when air is blown across its open neck.

Although not illustrated, it is also envisioned that the head portion 40 could be configured to provide a visual alignment indicator, such as by providing a notch, projection, or coloring on its proximal (top) portion. And that such alignment indicator could be used in conjunction with external or internal devices to sense whether the virtual "face" of the training club is open, closed, or square at various points during training swings of the club. Such sensing devices can also determine swing path and club head speed, and can display them on proprietary external display devices and/or on smartphones running appropriate apps, and/or on a display device integrated into the training club of the present disclosure.

The above represents example principles. Many embodiments can be made using these principles. The inventions are not limited to the specific preferred embodiments described and illustrated.

What is claimed is:

1. A swing speed training club comprising:

(a) a shaft having a butt end and an opposed tip end;

(b) a head portion affixed to the tip end of the shaft, and wherein the head portion is configured so that a mass of the head portion is manually adjustable between a predetermined minimum mass and a predetermined maximum mass without the use of any tool; and wherein:

(c) a line extends centrally through the shaft from the butt end to the tip end defining a shaft central longitudinal axis;

(d) the head portion comprises a generally cylindrical body having a generally circular top, an opposed and generally circular bottom and a circumferential side wall extending between the top and the bottom, wherein a line extending centrally through the body from the top of the body to the bottom of the body defines a body central longitudinal axis;

(e) the body is affixed to the tip end of the shaft so that the tip end of the shaft is adjacent to the top of the body, and the shaft and the body are arranged so that the shaft central longitudinal axis and the body central longitudinal axis are coaxial;

(f) the head portion further comprises three separate and generally cylindrical weights:

(g) the body comprises three weight-receiving chambers, each formed and arranged in the body so as to have an opening at the top of the body and to be at least partially closed at the bottom of the body, each chamber comprising a separate and generally cylindrical side wall, and each of a size corresponding to that of a respective one of the separate cylindrical weights, so that the separate cylindrical weights may each be manually loaded into and manually removed from the respective weight-receiving chambers by way of the chamber openings at the top of the body without the use of any tool;

(h) and wherein the head portion further comprises a keeper at the top of the body that is manually movable without use of any tool, between a first position to load or unload some or all of the three separate cylindrical weights into or from some or all of the three weight-receiving chambers, and a second position to secure each separate cylindrical weight in a respective weight-receiving chamber when it is loaded therein.

2. The swing speed training club of claim 1 wherein the club is configured for overspeed training of a user's golf swing, and wherein the shaft is between about forty-two inches and about forty-six inches in length and is generally circular in transverse cross-section, is tapered from the butt end to the tip end, and comprises a gripping portion near the butt end.

3. The swing speed training club of claim 2, wherein the taper of the shaft is not continuous from the butt end to the tip end.

4. The swing speed training club of claim 2, wherein:

(a) the shaft has a diameter of about 0.58 inch at the butt end and of about 0.33 inch at the tip end, and weighs between about 60 to 85 grams;

(b) a combined mass of the body of the head portion and the keeper is about 154 grams; and (c) each of the three separate cylindrical weights is of substantially a same size and shape and has a mass of about 27 grams, so that the head portion is configured to be weight-adjustable in discrete increments from a minimum weight of about 154 grams to a maximum weight of about 235 grams.

5. The swing speed training club of claim 4 wherein the bottom of the body of the head portion is configured to produce a humming or whistling sound when the club is gripped near the butt end of the shaft and is swung through the air so that the head portion moves through air at or above a threshold speed but not at speeds below the threshold speed.

6. The swing speed training club of claim 1, wherein each weight-receiving chamber extends from the top of the body to near the bottom of the body in parallel to the body central longitudinal axis, and wherein the generally cylindrical side wall of each chamber extends more than 180 degrees, but less than 360 degrees, around a circumference of the chamber, whereby a portion of the generally cylindrical side wall of each chamber is open through the side wall of the body, with no dimension of the open portion of each generally cylindrical chamber side wall being large enough to permit loading or unloading of each separate weight through said open portion of each generally cylindrical chamber side wall.

7. The swing speed training club of claim 6, wherein the body of the head portion comprises a generally cylindrical neck extending upwardly from a central portion of the top of the body, wherein the keeper comprises a central bore sized to fit over the neck, and the keeper is fitted over the neck and is manually rotatable about the neck without need for any tool, and wherein the keeper further comprises three radially-extending arms, each having such a configuration and length that the keeper can rotate so that in the first position of the keeper, each arm blocks off the opening in the top of the body of a respective one of the weight-receiving chambers, and in the second position of the keeper, none of the arms blocks the respective openings of the three weight-receiving chambers at the top of the body.

8. The swing speed training club of claim 7, wherein the neck is externally threaded and the central bore of the keeper is internally threaded, so that the keeper can be manually screwed up and down on the neck of the body between the first position of the keeper and the second position of the keeper without need for any tool.

9. The swing speed training club of claim 7, wherein the separate generally cylindrical weights are each formed with a central dimple in each end, and a portion of each keeper arm that blocks off a top of each weight-receiving chamber is fitted with a ball nose spring plunger mechanism that, in the second position of the keeper, is adapted to engage an upwardly facing dimple of a loaded weight, and thereby center the weight and secure the weight within the chamber.

10. The swing speed training club of claim 1 wherein a respective bottom of each of the weight-receiving chambers is completely closed at the bottom of the body of the head portion.

* * * * *